US007641489B1

(12) United States Patent
Hsu et al.

(10) Patent No.: US 7,641,489 B1
(45) Date of Patent: Jan. 5, 2010

(54) SAFETY PLUG SOCKET

(76) Inventors: Chih-Hua Hsu, P.O. Box No. 6-57, Junghe, Taipei City 235 (TW); Yung-Shun Chiang, P.O. Box No. 6-57, Junghe, Taipei City 235 (TW)

( * ) Notice: Subject to any disclaimer, the term of this patent is extended or adjusted under 35 U.S.C. 154(b) by 0 days.

(21) Appl. No.: 12/369,544

(22) Filed: Feb. 11, 2009

(51) Int. Cl.
*H01R 13/44* (2006.01)

(52) U.S. Cl. ..... 439/188; 439/651; 200/51.09

(58) Field of Classification Search ..... 439/188, 439/346, 347, 651; 200/51.09
See application file for complete search history.

(56) References Cited

U.S. PATENT DOCUMENTS 4,148,536 A * 4/1979 Petropoulsos et al. ..... 439/188
4,283,102 A * 8/1981 Richier ..... 439/188
5,374,199 A * 12/1994 Chung ..... 439/188
7,041,918 B1 * 5/2006 Wu ..... 200/51.09

* cited by examiner

*Primary Examiner*—Hlen Vu
(74) *Attorney, Agent, or Firm*—Muncy, Geissler, Olds & Lowe, PLLC

(57) ABSTRACT

The present invention discloses a safety plug socket, which mainly includes a sliding insulating base disposed within an outer housing. A pair of contact conducting strips is located on a bottom surface of the sliding insulating base, and conductive clips disposed internal of a pair of socket holes extend to the bottom portion of the outer housing and form folded strips. When a pair of plug terminals is correctly inserted, then the sliding insulating base is pressed down, thereby causing the lower contact conducting strips to make conductive contact with the folded strips, and causing clips on the conductive clips to make contact with the inserted plug terminals to supply power for use by an electronic product. When a plug is incorrectly inserted or metallic foreign body is inserted, then no electric conduction is realized.

7 Claims, 6 Drawing Sheets

SAFETY PLUG SOCKET

BACKGROUND OF THE INVENTION (a) Field of the Invention

The present invention relates to an Innovative structural design of a safety plug socket, and more particularly to a safety plug which provides power only when a pair of plug terminals are correctly inserted.

(b) Description of the Prior Art

A plug socket enables a pair of plug terminals to be inserted therein to effect the supply of power. The traditional plug socket is provided with socket holes in the outer housing, and conductive clips are internally fixed corresponding to the socket holes. The conductive clips are connected to an electric wire which provides a power source, and the conductive clips clamp the inserted terminals, thereby enabling the plug to effect the supply of power.

In prior art technology, in order to achieve preventing a metallic foreign body from being inserted into a plug socket and creating the danger of electric shock, movable cover plates are disposed within the socket holes to seal the socket holes. When not in use, the cover plates remain in a closed position to prevent the intrusion of foreign bodies.

In such prior art technology, because the conductive clips retain electric power, if a long thin or (squared-off) U-shaped metallic foreign body is made to extend into the socket holes and make contact with the conductive clips, there is still the possible danger of electric shock occurring. Thus the need for improvement exists.

SUMMARY OF THE INVENTION

A primary objective of the present invention is to provide a safety plug socket, wherein a safety plug supplies power to a plug for use by an electronic product connected thereto only when a pair of plug terminals is correctly inserted.

However, when the pair of plug terminals is incorrectly inserted or a metallic foreign body is inserted, then electric conduction is not realized, thereby preventing the danger of an electric shock.

The present invention is primarily structured to comprise a sliding insulating base disposed within an outer housing of a safety plug socket. A pair of contact conducting strips is located on the bottom surface of the sliding insulating base, and conductive clips disposed internal of a pair of socket holes extend to the bottom portion of the outer housing and form folded strips. When a pair of plug terminals is correctly inserted, then the sliding insulating base is pressed down, thereby causing the lower contact conducting strips to make conductive contact with the folded strips, and causing clips on the conductive clips to make contact with the inserted plug terminals to supply power for use by an electronic product.

To enable a further understanding of said objectives and the technological methods of the invention herein, a brief description of the drawings is provided below followed by a detailed description of the preferred embodiments.

DETAILED DESCRIPTION OF THE PREFERRED EMBODIMENTS

Figure 1:
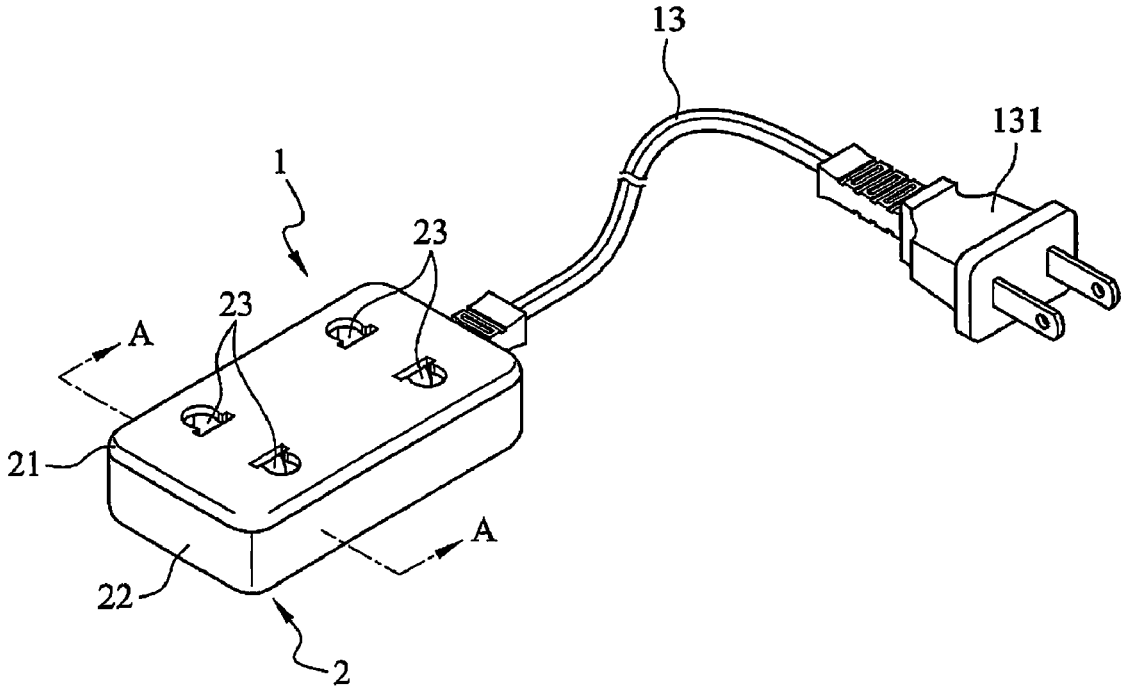
FIG. 1 depicts an outward appearance of an embodiment according to the present invention.
Figure 2:
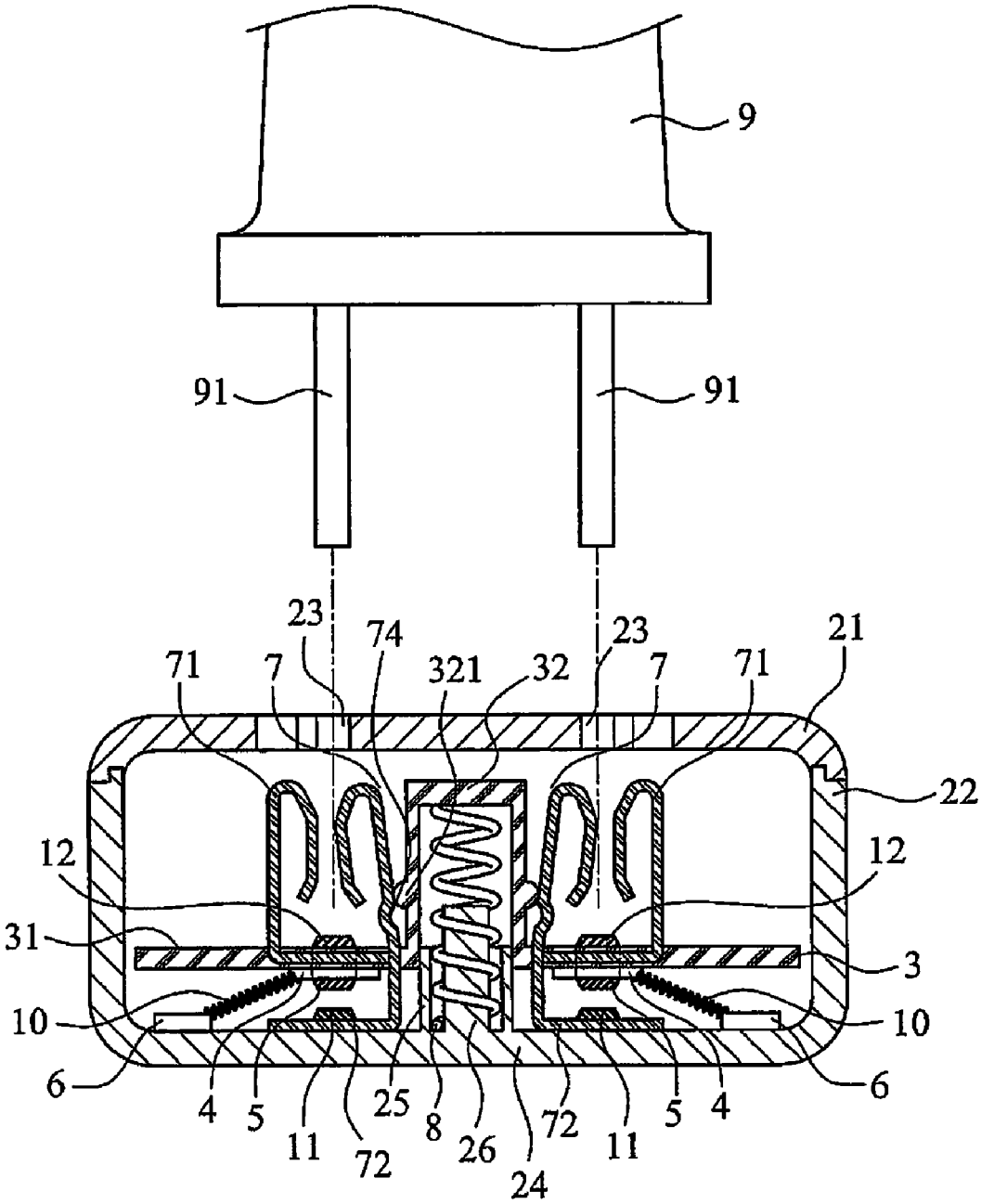
FIG. 2 depicts a cross-sectional view of the embodiment along AA according to the present invention.

Referring to FIG. 1 and FIG. 2, the present invention provides a safety plug socket for plug terminals of electronic products to be inserted therein and effect the supply of power, wherein a safety plug socket 1 is primarily structured from an outer housing 2, an electric wire 13, at least one pair of conductive clips 7, at least one sliding insulating base 3 and at least one pair of power contacts 6.

The outer housing 2 is structured from an upper case 21 and a lower case 22, wherein the upper case 21 is provided with at least one pair of socket holes 23 to enable insertion of terminals 91 of a plug 9 therein; the number of pairs of socket holes 23 being designed according to needs, for example, FIG. 1 depicts two pairs of the socket holes 23. A cylindrical spring base 25 extends from a bottom portion 24 of the outer housing 2 corresponding to the midpoint position of the respective pair of socket holes 23, and the lower portion of a spring 8 is retained within the cylindrical spring base 25. A guide column 26 used as support in the interspace of the spring 8 is further located within the cylindrical spring base 25. An end of the electric wire 13 is connected to a plug 131 to enable effecting the supply of power, and the electric wire 13 extends into the outer housing 2.

The conductive clips 7 are in paired configuration, the number of pairs being in accordance with the number of pairs of the socket holes 23, and the conductive clips 7 are disposed within the outer housing 2 corresponding to the pairs of socket holes 23. Clips 71 of each of the conductive clips 7 are disposed internal of one of the socket holes 23, and the conductive clips 7 are further provided with folded strips 72 extending to the bottom portion 24 of the outer housing 2. Moreover, a concavity 74 is defined in at least one side of the clips 71.

The number of sliding insulating bases 3 is in accordance with the number of pairs of the socket holes 23, and each is provided with a horizontal plate 31, and the center of the sliding insulating base 3 upwardly forms a cylinder 32. At least one side of the cylinder 32 is provided with a protruding point 321 and configured to be opposite to the concavity 74 on the side of the clip 71 relative thereto. The bottom surface of the horizontal plate 31 is provided with a pair of contact conducting strips 4 corresponding to the folded strips 72 of the pair of conductive clips 7. Moreover, the inside diameter of the cylinder 32 is greater than the outer diameter of the cylindrical spring base 25 and retains the upper portion of the spring 8, which enables the pair of contact conducting strips 4 to maintain non-contact separation with the folded strips 72 in normal times.

The power contacts 6 are in paired configuration, the number of pairs being in accordance with the number of pairs of the socket holes 23, and are disposed in a separated configuration within the outer housing 2 and conductively connected with the electric wire 13. Moreover, the power contacts 6 are respectively conductively connected to the pair of contact conducting strips 4 on the bottom surface of the horizontal plate 31 of the sliding insulating base 3 using soft conducting strips 10.

Furthermore, a pair of first contact points 5 extend from the pair of contact conducting strips 4, and a pair of second contact points 11 extend from the folded strips 72. When the sliding insulating base 3 is pressed down, the first contact points 5 make contact with the second contact points 11, thereby causing the contact conducting strips 4 to make conductive contact with the folded strips 72. A pair of contact portions 12 is located on top of the horizontal plate 31 of the sliding insulating base 3, and the contact portions 12 respectively contact the pair of plug terminals 91 when inserted into the safety plug socket 1.

Figure 3:
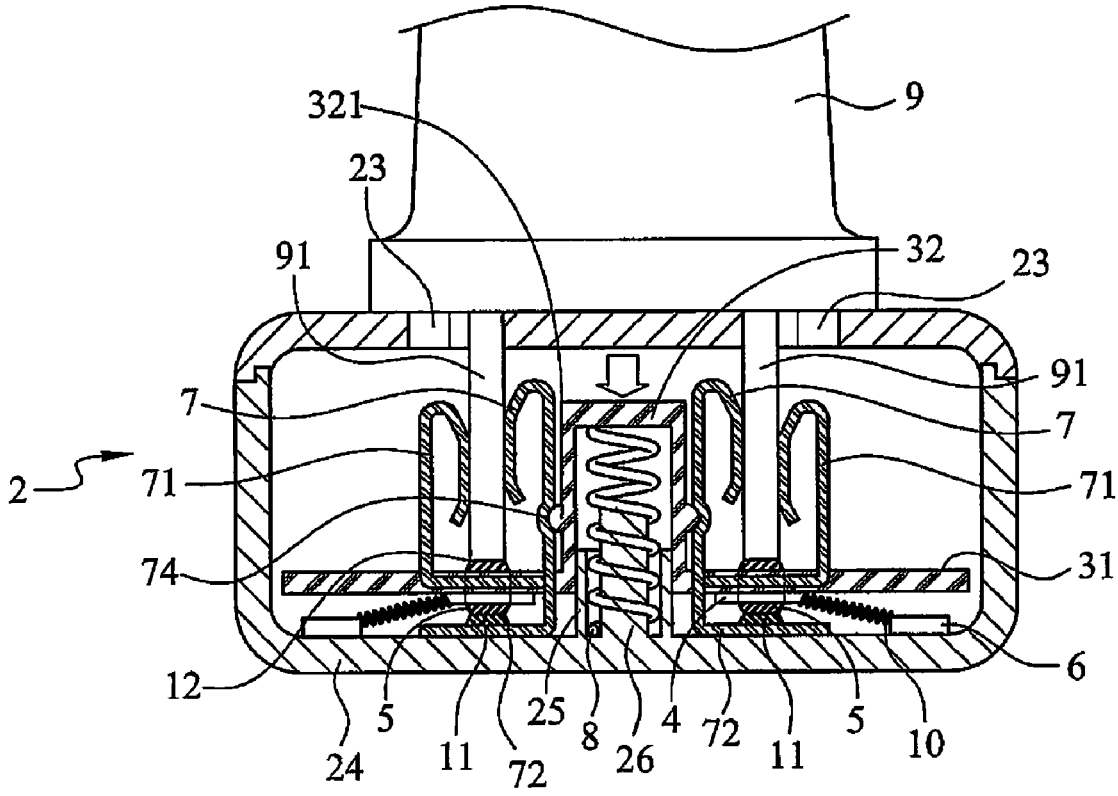
FIG. 3 depicts the same cross-sectional view as FIG. 2, with a plug correctly inserted.

Referring to FIG. 3, when using the present invention, the terminals 91 of the plug 9 are inserted into the socket holes 23 of the outer housing 2 until the plug terminals 91 make contact with the contact portions 12 of the sliding insulating base 3, thereby causing the sliding insulating base 3 to be pressed down (as depicted by the arrow in the drawing), and causing the protruding point 321 on one side of the cylinder 32 to fixedly join with the concavity 74 on one side of the clip 71. Moreover, the lower contact conducting strips 4 makes conductive contact with the folded strips 72 of the pair of conductive clips 7, thereby enabling the plug to effect the supply of power and supply electricity for use by a connected electronic product.

Figure 4:
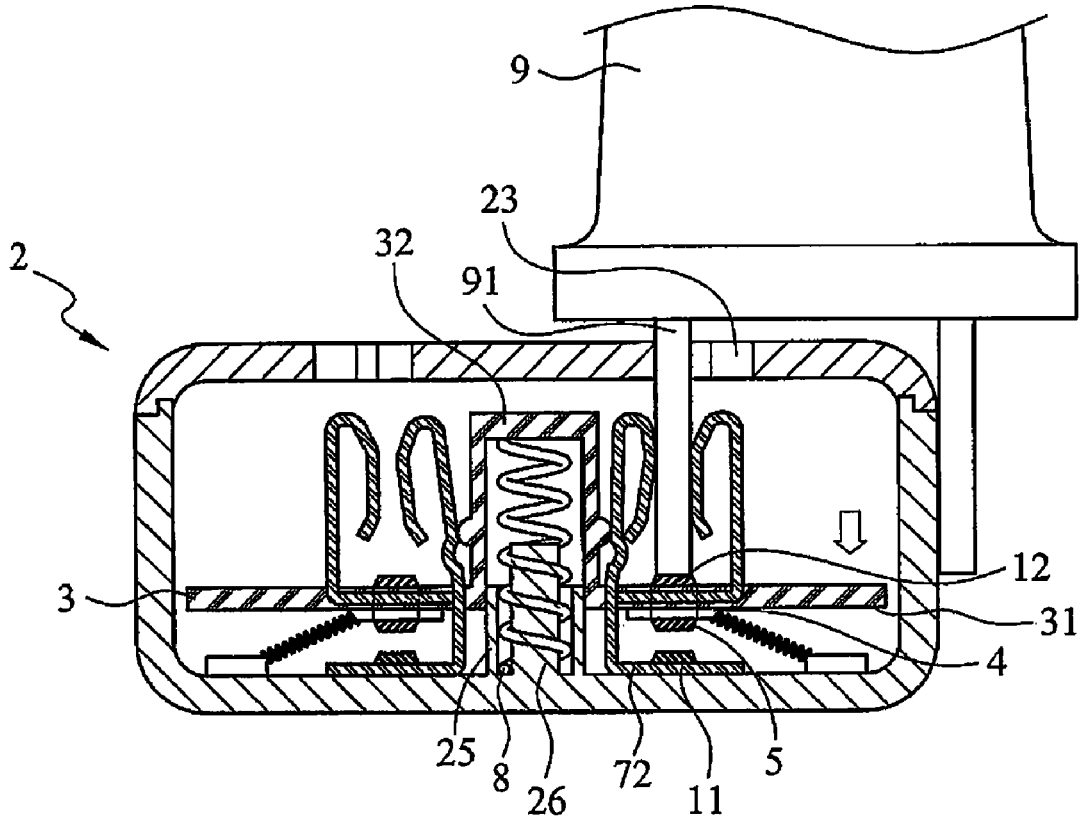
FIG. 4 depicts the same cross-sectional view as FIG. 2, with a plug incorrectly inserted.

Referring to FIG. 4, when the terminals 91 of the plug 9 are not correctly inserted, for example, when only one of the terminals 91 is inserted into the socket hole 23 as depicted in the drawing, then, from the structural configuration of the present invention, because the force subjected to the horizontal plate 31 of the sliding insulating base 3 is uneven, thus, the horizontal plate 31 becomes askew (in the direction as depicted by the arrow in the drawing), thereby causing the cylinder 32 to jam against the cylindrical spring base 25 and preventing horizontal plate 31 from being pressed down, thus, the contact conducting strips 4 do not make conductive contact with the folded strips 72, and the conductive clips 7 will not enable current flow, thus avoiding the danger of electric shock.

Figure 5:
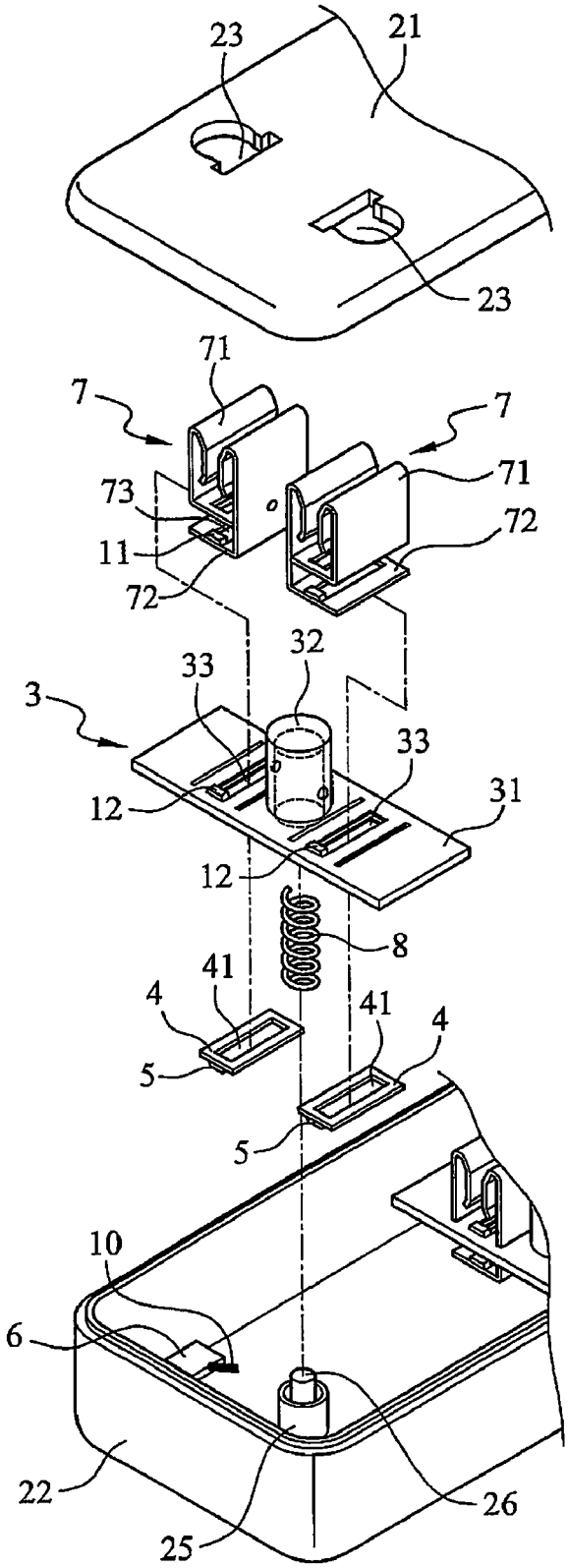
FIG. 5 depicts an exploded view of the embodiment according to the present invention.

Furthermore, referring to FIG. 5, the structure design of the present invention also comprises elongated holes 33 formed in the horizontal plate 31 at sides of the contact portions 12 corresponding to insertion positions of the plug terminals 91, and a first hollow portion 41, having an area larger than the elongated hole 33, is formed in each of the contact conducting strips 4, and a second hollow portion 73, having an area larger than the elongated hole 33, is formed in each of the folded strips 72. Such a design causes metallic foreign bodies to pass through the elongated holes 33, the first hollow portions 41 and the second hollow portions 73 when inserted into the socket holes 23, and thus prevents the metallic foreign bodies from causing the sliding insulating base 3 to shift down, thereby preventing the metallic foreign bodies from coming in contact with the contact conducting strips 4. Accordingly, metallic foreign bodies will not realize electric conduction after being inserted, thus achieving a safety effect, and in particular, provides a protective effect when a child inserts a metallic foreign body.

Figure 6:
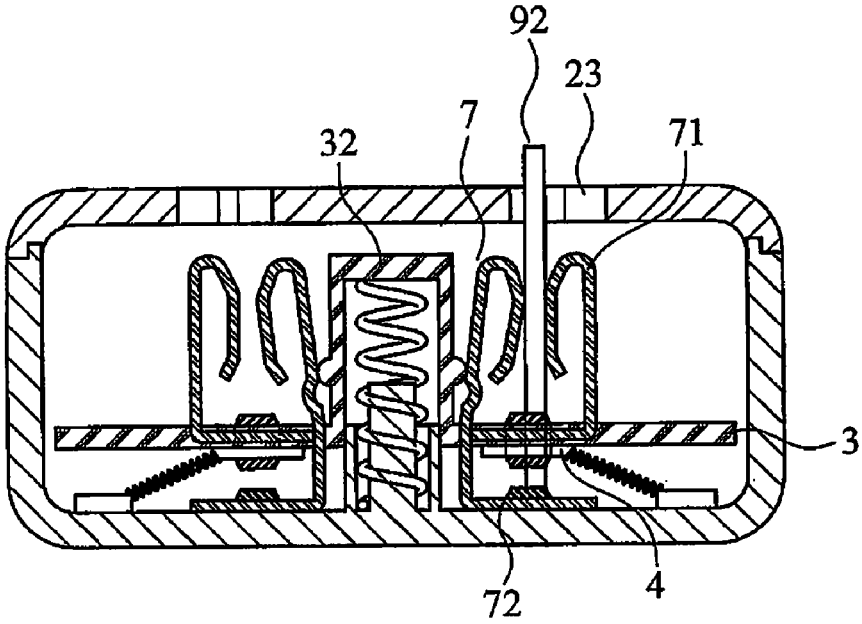
FIG. 6 depicts a cross-sectional view of a long thin metallic foreign body inserted into the present invention.

FIG. 6 depicts a situation whereby a long thin metallic foreign body 92 has been inserted into the socket hole 23, and after a long thin metallic foreign body 92 has been inserted into the socket hole 23, then a situation occurs whereby contact or non-contact is made with a top portion of the clips 71 of the conductive clip 7. However, because the metallic foreign body 92 passes through the elongated hole 33, the first hollow portion 41 and the second hollow portion 73, thus, it will not press down on the sliding insulating base 3, and the contact conducting strips 4 will not make conductive contact with the folded strips 72. Hence, there is no electric current in the conductive clip 7, thus, even if the metallic foreign body 92 does make contact with the clip 7, there is no danger of an electric shock.

Figure 7:
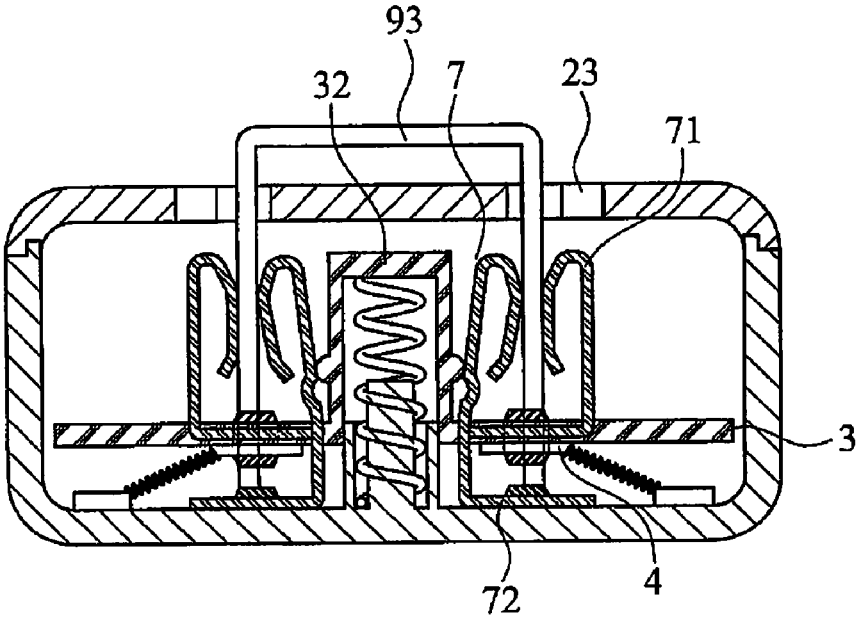
FIG. 7 depicts a cross-sectional view of a (squared-off) U-shaped metallic foreign body inserted into the present invention.

In addition, FIG. 7 depicts a situation whereby a (squared-off) U-shaped metallic foreign body 93 has been inserted, and after the squared-off U-shaped metallic foreign body 93 has been inserted into the socket holes 23, then a situation occurs whereby contact or non-contact is made with top portions of the clips 71 of the conductive clips 7. However, because the squared-off U-shaped metallic foreign body 93 passes through the elongated holes 33, the first hollow portions 41 and the second hollow portions 73, thus, it will not press down on the sliding insulating base 3, and the contact conducting strips 4 will not make conductive contact with the folded strips 72. Hence, there is no electric current in the conductive clips 7, thus, even if the squared-off U-shaped metallic foreign body 93 does make contact with the clips 7, there is no danger of an electric shock.

In conclusion, the innovative structure of the safety plug socket provided by the present invention only effects the supply of power after a pair of plug terminals are correctly inserted into the socket holes to supply power for use by an electronic products. However, there is no flow of electric current when the plug terminals are incorrectly inserted or other metallic foreign bodies are inserted, thus preventing the danger of an electric shock from occurring. Hence, the present invention completely complies with the essential elements as required for a new patent application. Accordingly, a new patent application is proposed herein.

It is of course to be understood that the embodiments described herein are merely illustrative of the principles of the invention and that a wide variety of modifications thereto may be effected by persons skilled in the art without departing from the spirit and scope of the invention as set forth in the following claims.

What is claimed is:

1. A safety plug socket, comprising:

an outer housing, provided with pairs of socket holes to enable insertion of plug terminals, a cylindrical spring base extends from a bottom portion of the outer housing corresponding to a middle position of the pair of socket holes, and a lower portion of a spring is retained within the cylindrical spring base;

an electric wire enables effecting the supply of power, and the electric wire extends into the outer housing; at least one pair of conductive clips, disposed within the outer housing corresponding to the pairs of socket holes, each of the conductive clips is disposed in one of the socket holes, and provided with folded strips extending to a bottom portion of the outer housing;

at least one sliding insulating base, a center of the sliding insulating base formed with a cylinder extending upwardly; a bottom surface of the horizontal plate is provided with a pair of contact conducting strips corresponding to the folded strips of the pairs of conductive clips; an inside diameter of the cylinder is greater than an outer diameter of the cylindrical spring base and retains an upper portion of the spring, the pair of contact conducting strips maintain separation with the folded strips in normal position; and at least one pair of power contacts, disposed in a separated configuration within the outer housing and conductively connected with the electric wire, the power contacts are respectively conductively connected to the pair of contact conducting strips on the bottom surface of the horizontal plate of the sliding insulating base;

when the terminals of a plug are inserted into the socket holes of the outer housing, the sliding insulating base being pressed down that causes the contact conducting strips to make conductive contact with the folded strips of the pair of conductive clips, and enabling the plug to effect the supply of power;

wherein a pair of first contact points extend from bottom surfaces of the pair of contact conducting strips, and a pair of second contact points extend from upper surface of the folded strips, when the sliding insulating base is dressed down, the first contact points make contact with the second contact points.

2. The safety plug socket according to claim 1, wherein a pair of contact portions are located on the upper surface of the horizontal plate of the sliding insulating base, and the contact portions respectively contact a pair of plug terminals when inserted into the safety plug socket.

3. The safety plug socket according to claim 2, wherein elongated holes are formed in the horizontal plate at sides of the contact portions corresponding to insertion positions of plug terminals, and a first hollow portion, having an area larger than the elongated hole, is formed in each of the contact conducting strips, and a second hollow portion, having an area larger than the elongated hole, is formed in each of the folded strips.

4. The safety plug socket according to claim 1, wherein the outer housing is structured from an upper case and a lower case.

5. The safety plug socket according to claim 1, wherein a guide column used as a support in the interspace of the spring is located within the cylindrical spring base of the outer housing.

6. The safety plug socket according to claim 1, wherein at least one side of the cylinder is provided with a protruding point.

7. The safety plug socket according to claim 1, wherein at least one side of the clips is provided with a concavity.

* * * * *